United States Patent [19]

Evans

[11] Patent Number: 4,961,330

[45] Date of Patent: Oct. 9, 1990

[54] HIGH SECURITY PANIC EXIT SYSTEM

[75] Inventor: Walter R. Evans, Lancaster, Ky.

[73] Assignee: Sargent & Greenleaf, Inc., Nicholasville, Ky.

[21] Appl. No.: 496,079

[22] Filed: Mar. 15, 1990

Related U.S. Application Data

[63] Continuation of Ser. No. 406,352, Sep. 12, 1989, abandoned.

[51] Int. Cl.[5] ..... E01C 15/02

[52] U.S. Cl. ..... 292/21; 292/92; 70/92

[58] Field of Search ..... 292/21, 92, 93, 240, 292/241; 70/92

[56] References Cited

U.S. PATENT DOCUMENTS

| | | | |
|---|---|---|---|
| 3,523,585 | 2/1971 | Welch | 292/92 |
| 3,582,122 | 6/1971 | Foster | 292/21 |
| 3,767,238 | 10/1973 | Zawadzki | 292/21 |
| 3,788,687 | 1/1974 | Zawadzki | 292/92 |
| 4,741,563 | 5/1988 | Cohrs | 292/21 |

*Primary Examiner*—Robert L. Wolfe

*Attorney, Agent, or Firm*—Mason, Fenwick & Lawrence

[57] ABSTRACT

A combined panic exit and combination lock assembly for a security area door including a panic exit device on the door inner side and a high security combination lock on the door outer side, wherein operation of a panic bar from within the security area concurrently retracts both the latch system of the panic exit device and the lock bolt of the combination lock for egress from the security area. However, retraction of the panic exit latch system and of the lock bolt from outside the door requires independent unlocking operation of both the panic exit device and combination lock. A primary latch bolt of the exit device is retracted by a rod member and main control link, and secondary outputs and associated secondary latch bolts are connected to bellcranks. One of the secondary outputs is connected to the combination lock bolt mechanism and its associated bellcrank is coupled by a lost motion linking system to the rod member so that retracting movement is imparted to the coupling link from the rod member without relative motion between them to achieve concurrent retracting movement of the latch bolts and lock bolt and relative lost motion movement of the coupling link with respect to the rod member is accommodated upon independent retraction of the lock bolt or the primary latch bolt from outside the door.

29 Claims, 5 Drawing Sheets

HIGH SECURITY PANIC EXIT SYSTEM

This application is a continuation of application Ser. No. 406,352, filed Sept. 12, 1989.

BACKGROUND AND OBJECTS OF THE INVENTION

The present invention relates in general to panic exit type latching devices for doors and the like, and, more particularly, to a novel concealed rod, panic exit door latching system having a latch bolt push-bar actuator for a three point locking system and a high-security combination lock interlinked therewith.

A number of panic exit or panic egress lock hardware has been developed, to provide for exit from school classrooms, auditoriums, theaters and the like, wherein an elongated push plate serving as a panic bar is supported for rectilinear movement toward and away from the adjacent surface of the door for activating a main latch bolt, or a pair of top and bottom latch bolts, or both the vertical edge and top and bottom latch bolts. Such panic exit devices are designed to be automatically released by a relatively small force and relatively slight movement applied to the panic bar from the inside of the building to facilitate actuation of the panic bar and unlocking of the door upon application of pressure toward the surface of the door upon which the panic exit device is mounted. Typically, such panic exit devices include a primary latch bolt mounted in the vertical free edge of the door at approximately the level of the panic exit device and a pair of secondary latch bolts at the top and at the bottom of the door, all operated from the panic bar. Usually, a main center case is provided having bell crank mechanisms interconnecting a rectilinearly reciprocating control link activated by a panic bar for operating the top and bottom latches by control rods connected from the bell crank members to such latches while the primary or center latch bolt is operated directly from the main control link. Examples of such panic exit devices are found in earlier U.S. patents such as U.S. Pat. Nos. 3,563,585 to Welch, 3,582,122 to Foster, 3,788,687, 3,767,238 to Zawadzki, 4,427,223 to Godec et al, 4,601,499 to Kim, and 4,741,563 to Cohrs as typical of this type of panic exit device.

Previous designs of the panic exit device have usually used a solid linkage between the main control link and the secondary outputs of the center case mechanism operating the top and bottom latch bolts. Thus when the secondary outputs were depressed, the main control link was retracted which in turn retracted the latch bolts of the panic exit device. In a two or three point latching system, defeat of any one of the latches in the system allowed unauthorized entry.

Such panic exit systems are also frequently used in security areas, wherein the panic exit device with its push bar release mechanism permits egress, while a remote access control system, such as a push button or card controlled access system or a key cylinder lock permits activation of the panic exit device from the exterior to retract the latch bolts.

The device of the present invention was developed to fulfill a need for a panic egress device which works in conjunction with a high security lock, such as a high security combination lock. From the outside of the door secured by the panic exit lock system, both the high security lock and the panic exit device must operate independently of each other. From the egress or inner side of the door, depressing the push pad or panic bar must retract both the bolts in the panic exit device and the bolt in the high security lock. This allows the device to meet both panic and high security requirements. Many applications exist where both the high security and panic exit or panic egress requirements are needed. Currently, the way in which these requirements are met is through the use of two door for a given room. One door is used for the panic exit requirement, with the door being provided with a panic exit device mounted on the inside with no means of entry from the outside. This door always remains locked from the outside. The other door uses a high security lock as a means for passage from the outside of the door to the inside. The present invention is designed to eliminate the need for two doors where both high security and panic egress requirements are needed, and which permits operation of the panic exit lock mechanism to retract the primary latch bolt responsive to and outside key or outside activation of a remote control access system without retracting the high security lock, and which provides that the primary latch bolt in the panic exit device will not retract when the high security lock is retracted. In other words, both the panic exit device and the high security lock must be unlatched independently of each other to gain entry from the outside. However, depressing the push pad or panic bar on the device retracts both the high security lock and bolt and the latch bolts of the panic device to permit egress.

An object of the present invention, therefor, is the provision of a novel high security exit lock system, including a mechanically operated panic exit lock device and a high security combination lock interlinked therewith, wherein unlocking and bolt retraction of the panic exit device and the high security combination lock are achieved independently without retraction of the primary latch bolt or the combination lock bolt effecting retraction of the other, so that both the panic exit device and the high security lock must be unlatched independently to gain entry from outside of the building.

Another object of the present invention is the provision of a high security exit device as described in the immediately preceding paragraph, wherein lost motion is provided between the main control link of the panic exit device and the bolt retracting mechanism of the combination lock whereby opening of the combination lock does not transfer opening movement to the main control link of the panic exit device and opening movement of the main control link of the panic exit device does not apply opening movement to the bolt retracting components of the combination lock.

Another object of the present invention is the provision of a novel high security exit device of the type described in the two immediately preceding paragraph, wherein a two or three point latching system involving two or three latching bolts respectively are provided in the panic exit device and the lock bolt of the combination lock is sufficiently independent of the mechanism for retracting the panic exit device bolts so that defeat of a panic exit device bolt and the combination lock bolt must be attained simultaneously to gain unauthorized entry.

Other objects, advantages and capabilities of the present invention will become apparent from the following detailed description, taken in conjunction with the accompanying drawing illustrating a preferred embodiment of the invention.

DETAILED DESCRIPTION OF A PREFERRED EMBODIMENT

Figure 1:
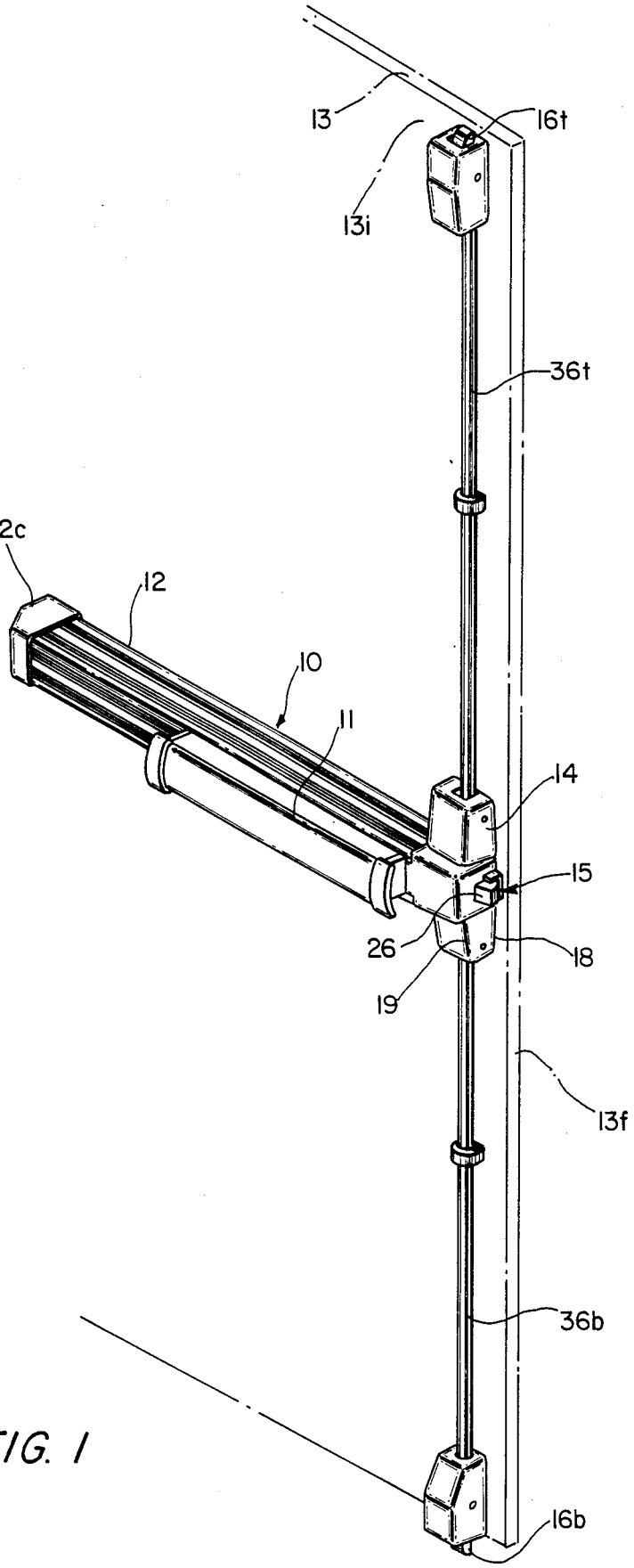
FIG. 1 is a perspective view of a three point panic exit locking device of the prior art.
Figure 2:
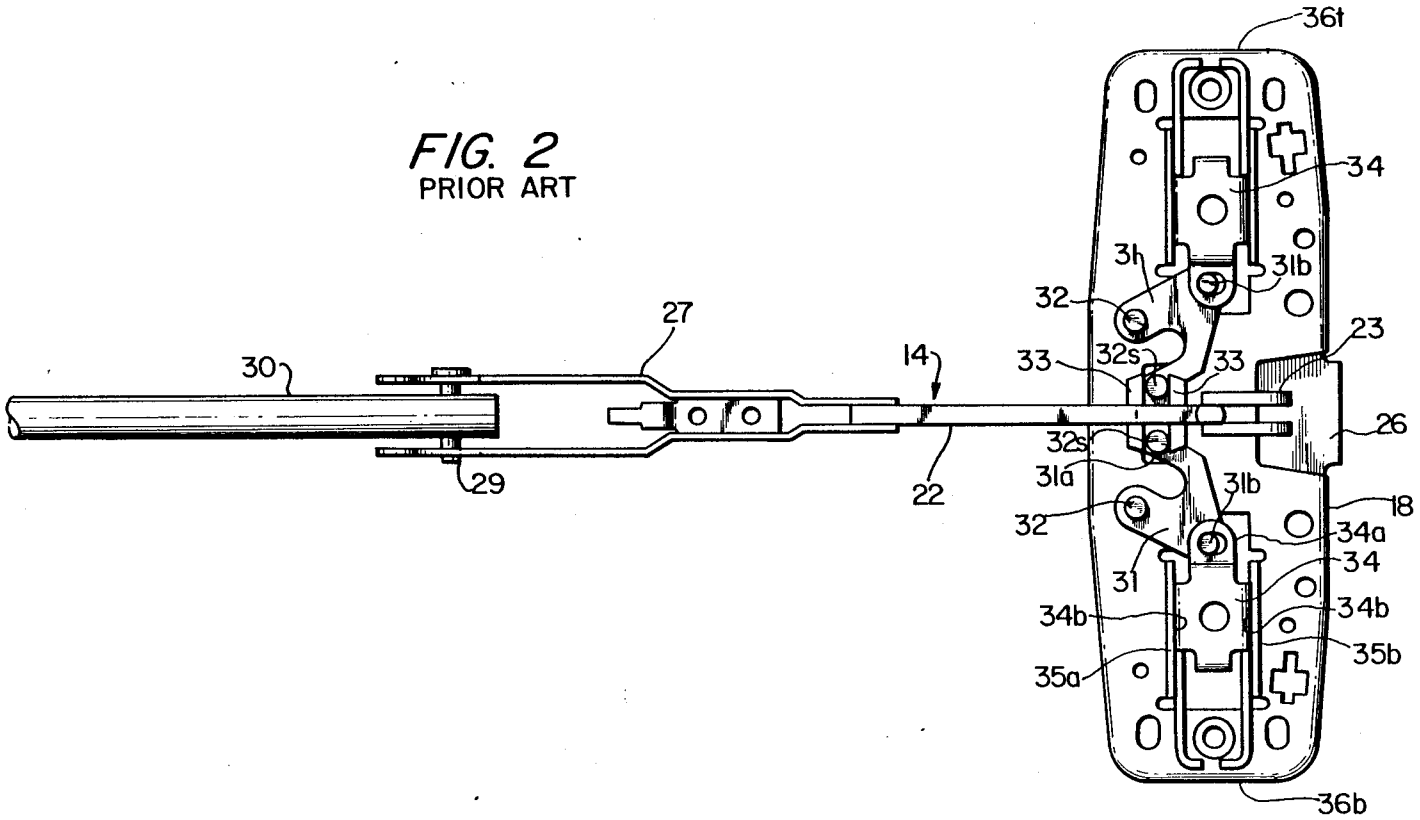
FIG. 2 PRIOR ART
FIG. 2 is a plan view, with parts broken away and parts shown in phantom lines, of the center case mechanism of a three point panic exit locking device of the prior art.
Figure 3:
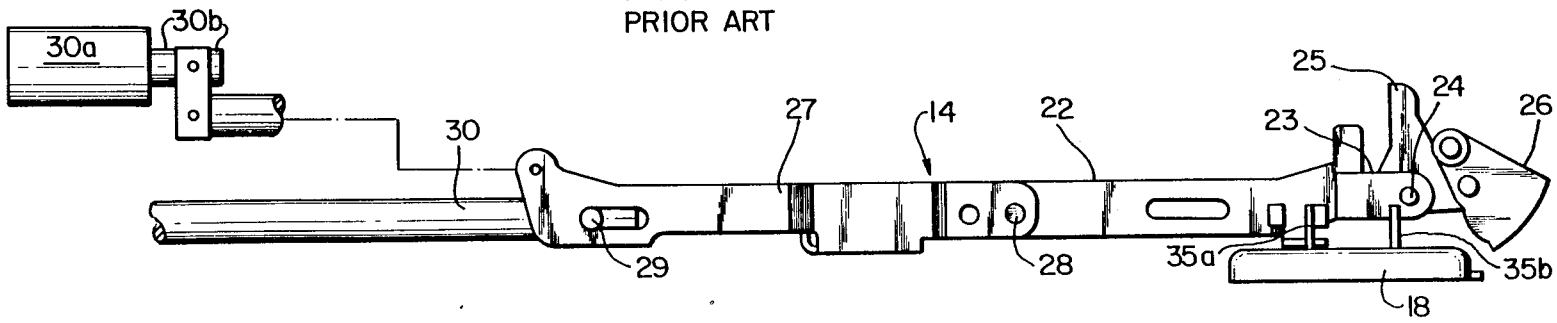
FIG. 3 PRIOR ART
FIG. 3 is a side elevation view thereof with the bell cranks and secondary latch outputs not shown, viewed from below FIG. 2.

Referring to the drawings, wherein like reference characters designate corresponding parts throughout the several figures, and particularly to FIGS. 1–3 showing a typical panic exit device as currently marketed, such devices typically comprise a center case subassembly, generally indicated at 10, usually provided at mid-height or about normal door-knob level on the inside surface of a door, which includes a horizontally elongated push bar 11 supported for movement outwardly and inwardly relative to a mechanism case 12 mounted on a door 13 to extend generally horizontally across the door. The center case subassembly 10 houses a movable latch bolt actuator mechanism 14 which is activated by movement of the push bar 11 inwardly of the mechanism case 12 toward the inside door surface 13*i*. The center case subassembly 10 is frequently in the form of what is termed a "universal" center case subassembly, signifying that it comprises parts usable in assembling either a rim-style center case assembly having a primary latch 15 projectable horizontally beyond the vertical free edge 13*f* of the door 13 into a keeper, or providing a vertical secondary bolt assembly formed of a pair of latch bolts 16*t* and 16*b* at the top and bottom respectively of the door projectable in the stationary keepers in the door lintel and threshold or floor, or is usable in a combination rim type and vertical type lock arrangement, termed a "three point" latching system, as illustrated in FIG. 1.

In such a typical panic exit device, one end of the mechanism case 12, which may be formed as an aluminum or other metallic extrusion, is closed by an end cover 12*c* fixed to the mechanism case by an end cap bracket 12*d*. The other end of the mechanism case is fixed to a latch mechanism support plate 18 covered by a removable cover 19 fixed to the plate 18 by mounting screws. A trim plate 20, typically having a handle 20*h*, is aligned with the support plate and the two plates 18 and 20 are mounted in spaced apart relation, on the door or similar closure, by spacers and mounting screws or bolts coupled to the center case support plate 18.

The center case portion 10 of such assembly forms a control link housing in which is mounted an elongated main control link 22 slidably supported in the housing 12 and having an end formation 23 in the form of a clevis which is pinned, for example, by transverse pin 24 to a latch bolt link 25 controlling projecting and retracting movement of a pivoted latch bolt 26. The manner in which the main control link 22 is caused to slidably translate in the housing 12 is well known to those skilled in the panic exit mechanism art, an example of such mechanisms being disclosed in earlier U.S. Pat. No. 4,741,563.

In the illustrated mechanism, a control linkage member 27 is pinned to one end of the main control link 22, as indicated at 28, located at the end opposite the pin 24 passing through the latch bolt link 25. This linkage system, according to practices well-known in the prior art, is operated by a link translating mechanism of the panic exit device to translate the clevis 23 and link 24 lengthwise to retract and extend the primary latch bolt 26. Such mechanisms are shown for example in U.S. Pat. Nos. 4,167,280 and 3,767,238. The opposite end of the control linkage 27 is coupled by a pin and slot connection, indicated generally at 29, to an action rod 30 which is retracted axially by a lever mechanism upon depression of the push bar 11. An additional action rod (not shown) may be connected to the main control line 22 and operated by a known remotely activated electrical access control, such as a push button digital access electronic lock control system operated by a selected code being entered, such as that produced by Sargent & Greenleaf, Inc., under the trademark CODETRONIC, disclosed in U.S. Pat. No. 3,953,769, or any of the known card control access systems, capable of supplying an activating signal to a solenoid 30*a* having an armature 30*b* coupled to the additional action rod. The action rod 30 and control linkage and latch bolt 26 are returned to the projected position by the usual return spring system incorporated in such panic exit devices.

Also, the support plate 18 pivotally supports a pair of bell cranks 31, for example by pivot pins 32 fixed to the support plate 18. Each bell crank 31 has a first end 31*a* carrying a formation such as a sphere 32*s* which is a received between shoulders 33 on the main control link 22 for imparting appropriate rotary movement to the bell cranks 31, while the other end 31*b* of each bell crank is pivotally coupled by pin and slot formations 34*a* to slide block members 34 forming secondary latch outputs for the lock assembly. These slide block formations or secondary latch output members 34 are of generally rectangular channel shape as viewed in FIG. 2 providing rectangular block-like structures having parallel side surfaces 33*b* which slide between guide surfaces 35*a*, 35*b* projecting from the plate 18. These slide block formations or secondary latch outputs 34 are each coupled to respective top and bottom latch bolt actuator rods 36t and 36b to effect retraction of the pivoted top and bottom latch bolts 16t and 16b.

Figure 4:
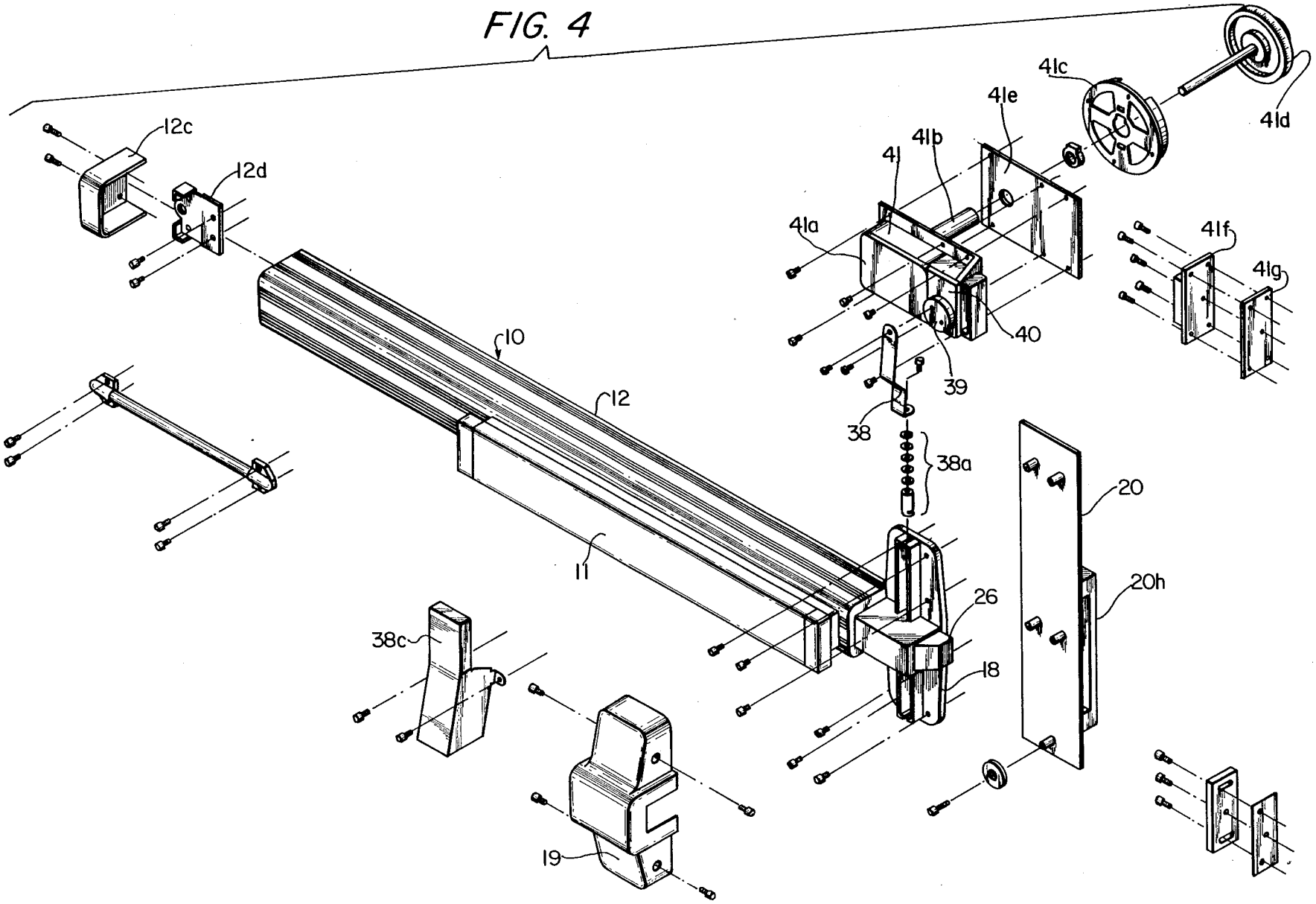
FIG. 4 is a fragmentary exploded perspective view of a panic exit device intercoupled with a high security combination lock mechanism and associated deadbolt section in accordance with the present invention showing the interlinking components and cover therefor.

The customary prior art manner of incorporating a combination lock with such a panic exit device has been to connect a bracket such as is shown at 38 in FIG. 4 at its lower end to the upper secondary latch output member 34, for example by threaded bolt and bracket connector stud fasteners 38a, while the uppermost end of the bracket 38 is connected to the control knob or disc 39 protruding from a deadbolt subassembly 40 associated with the combination lock mechanism 41. The combination lock mechanism 41 may, for example, be of the type disclosed in prior U.S. Pat. No. 4,163,376 of Aug. 7, 1979 and the deadbolt section 40 may be, for example, a Sargent & Greenleaf deadbolt section as heretofore sold by Sargent & Greenleaf such as is incorporated in the Model 8470 combination lock with deadbolt. Such typical combination lock mechanisms include a lock housing or case 41a to be mounted to the inner surface of the door or closure, together with a spindle receiving tube 41b extending forwardly through the door and through a dial ring 41c to be mounted on the exterior surface of the door and provide a bearing for the dial and knob member 41d. A protective hard plate 41e may be provided in forwardly covering relationship to the lock case mechanism to resist drill penetration into the lock mechanism case. A conventional strike plate 41f and adjustment shim 41g are also shown exploded from their normal position mounted on the associated door jamb confronting the bolt of the deadbolt section 40. A suitable cover 38c for the bracket 38 is also shown in FIG. 4 and is secured by mounting screws over the bracket in the finished installation.

The combination lock bolt, indicated at 41h, of the combination lock which is retracted and projected in the usual manner, for example, as disclosed in said earlier U.S. Pat. No. 4,163,376, includes the usual fence lever 41i having a nose formation and fence as described in said earlier patent coacting with the tumbler wheels of the combination lock. The bolt, however, is of the configuration illustrated in FIG. 5 providing a lost motion connection with the bolt member 42a of the deadbolt subassembly 40. This is provided, for example, by having a somewhat T-shaped rear portion 42b extending toward the bolt 41h of the combination lock 41, having oppositely projecting flange or lip formations 42c slidably engaging opposite parallel confronting side walls 41j of the re-entrant or C-shaped recess 41k in the combination lock bolt 41h. This arrangement causes the T-shaped end portion or rear extension 42b of the deadbolt section bolt member to be captured in the recess 41k of the combination lock bolt 41h but permits relative sliding movement so that the deadbolt bolt member 42a may be retracted to unlocking position while the combination lock bolt 41h is still in the projected or locking position.

Figure 5:
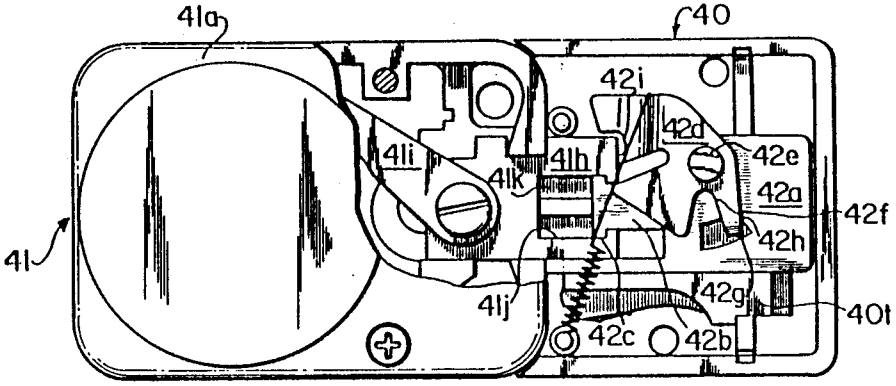
FIG. 5 is a rear elevation view of the deadbolt section and modified combination lock bolt used in the panic exit device.

The deadbolt section 40 as shown in FIG. 5 includes a spring biased release lever 42d pivoted to the bolt member 42a, as indicated at 42e, and having a finger portion 42f terminating in a tip interfitting in the recess 42g of the bolt member 42a, thus providing a lost motion connection. The release lever 42d has a shaped recess 42h receiving an eccentric pin projecting from the control knob or disc 39 whereby, upon rotation of the control knob or disc 39 in a counterclockwise direction, the release lever 42d is shifted through a limited arc raising the shoulder formation 42i to a release position located above the upper edge of the combination lock bolt 41h and bringing the projection on the tip of the finger formation 42f to the left end of the recess 42g, as viewed in FIG. 5, whereupon further counterclockwise rotation of the control knob or disc 39 effects retraction of the bolt 42a to unlocking position. The deadbolt section 40 is also provided, for extra security, with an automatic deadbolt trigger system, consisting of slidable automatic deadbolt tripper 40t and associated spring-biased catch lever 40c, which enables the high security lock assembly to be set in the locked position while the door is open and effect positive locking when the door is closed.

It will be understood that because of the connection between the bracket 38 coupled eccentrically to the control knob or disc 39 and one of the secondary latch outputs 34 of the panic exit device, depression of the push bar 11 of the panic exit device effects retracting movement of the main control link 22 and action rod 30, causing rotation of the bell cranks 31 and retraction of the secondary latch outputs 32 toward the control link 22, causing retraction of the primary or center latch bolt 26 and the secondary or top and bottom latch bolts 16t and 16b. Movement of the secondary latch output 34 to which the combination lock deadbolt section control knob 39 is linked by the bracket 38 also effects appropriate rotation of the control knob 39 to rotate the control lever 42d counterclockwise and achieve retraction of the lock bolt 42a. Similarly, dialing of the proper combination for the high security combination lock 41 and its associated deadbolt section 40 and rotation of the dial and knob to effect retraction of the combination lock-bolt 41h also causes retraction of the bolt 42a and this in turn causes rotation of the control knob 39 linked through the bracket 38 to one of the secondary latch outputs 34, and because of the positive connections through the bell cranks 31 to the main control link 22, simultaneous retraction of all of the latch bolts 26 and 16t and 16b is effected.

Because of the positive interconnection between the panic exit device and the high security combination lock as described above, it would be apparent that defeat of any one of the panic exit device latches, all of which are positively interlinked together, will effect simultaneous retraction of all of the panic exit device latch bolts as well as the bolt 42a of the deadbolt section 40 of the high security combination lock assembly. This is undesirable as the high security sought to be achieved with the high security combination lock controlling entry from the exterior of the room or building can be thus comprised by merely defeating one of the latch bolts of the panic exit device. What is needed in applications where both high security and panic egress requirements are present is that the mechanism be so arranged that the panic exit device and the high security combination lock must be unlatched independently to gain entry, such that when the high security lock bolt is retracted by inputing the proper combination in the combination lock, to achieve retraction of the combination lock bolt 41h, and its associated deadbolt section bolt 42a, only the secondary latch outputs 34 and their associated latch bolts 16t and 16b are retracted, but this does not effect retraction of the primary or center panic exit device latch bolt 26. The difficulty with such prior art arrangements is that defeat of any one of the latch bolts in a two or three point latching system allowed unauthorized entry from the exterior or outside of the door because, due to the positive interlinking of the combination lock assembly bolt and the panic exit device bolts, as forcing of any of the latch bolts to retracted position caused simultaneous retraction of all bolts including the combination lock bolt.

The present invention is directed to a modification of the above described structure to enable a single door to be used for the panic exit requirement, in applications where both the high security and panic egress requirements are needed, for example, to eliminate the need for two doors wherein one door has a panic exit device mounted on the inside with no means of entry from the outside to always remain locked from the outside, or allows entry by digital access control or card control or the like, and another door having a high security lock providing a means for passage from the outside of the door. The modified panic exit device structure of the present invention also provides greater security against surreptitious or unauthorized entry from outside the building or room, as this modified system only allows unauthorized entry when two latches are defeated simultaneously, thus making defeat of the system much more difficult than in the prior art arrangement for 2 or 3 point latching systems where defeat of any one of the latches allows entry.

The modified panic exit device construction of the present invention includes the additional of a lost motion connection between the primary action rod 30 of the panic exit device and the secondary latch outputs, which allows the panic exit device and the high security combination lock to operate independently. In this arrangement, when the high security combination lock is operated to retract its bolt, the primary latch bolt system in the panic exit device will not retract. Both the panic exit device, as by proper actuation of the digital or card actuated access control or a key lock and the high security combination lock must be unlatched independently to gain entry. Depressing the push pad on the panic exit device retracts both the high security lock bolt and the latch bolt system of the panic exit device, thus permitting exit from the secured room.

Figure 9:
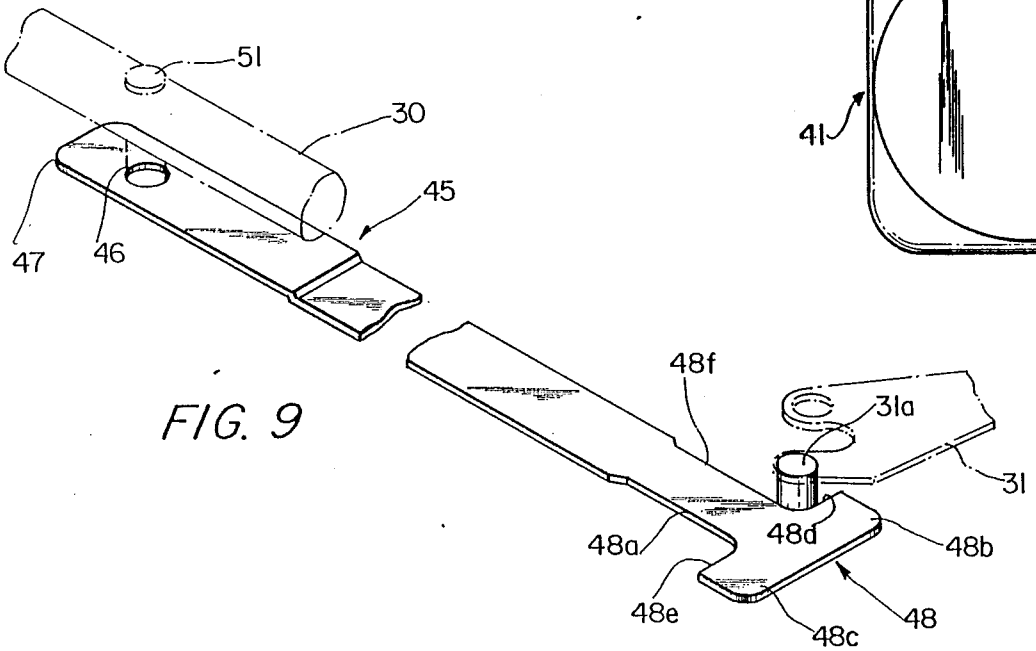
FIG. 9 is a fragmentary perspective view of the lost motion, connector, with adjacent structure shown in broken lines.
Figure 8:
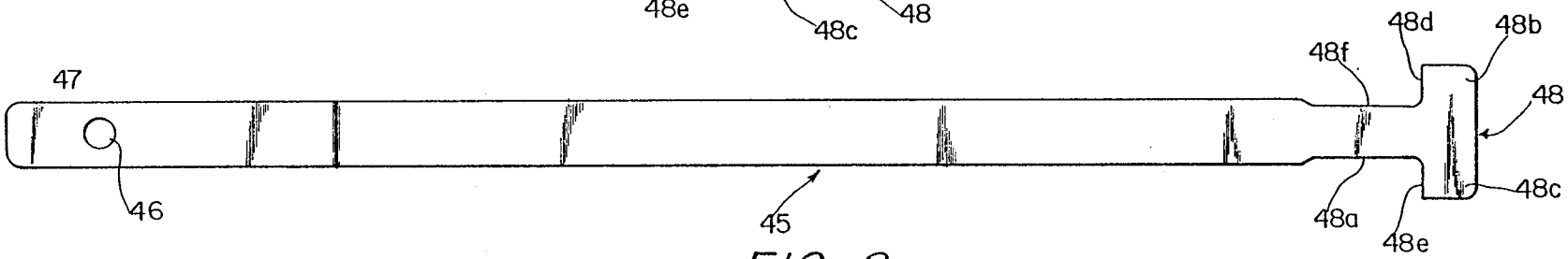
FIG. 8 is a plan view, with parts broken away, of the lost motion connector used in the mechanism of the present invention.

The lost motion coupling of the present invention comprises a lost motion trigger stamping or lost motion coupling link 45, which is longitudinally movable relative to the base plate of the mechanism case 12 and is provided with a hole 46 adjacent the distal end 47 thereof to receive an actuating pin 51 extending from the action rod 30 and is provided with a T-shaped head 48 at the proximal end 49 thereof. The T-shaped head 48 has a somewhat narrowed shaft portion **48*a* forming an extension of the remainder of the link 45 and a pair of oppositely extending arms 48*b*, 48*c* projecting transversely of the link 45 and defining rearwardly facing shoulders 48*d*, 48*e* adjoining the narrowed shaft portion 48*a*, as shown in FIGS. 8 and 9. One of the shoulders 48*b* or 48*c* normally abuts an inwardly extending pin 31*a* on one of the bellcranks 31, locating the pin 31*a* in a corner of the T-shaped head at a juncture of the shaft 48*a* and one of the arms 48*b* or 48*c*. The bellcranks 31 are like those incorporated in the prior art panic exit device of FIGS. 2 and 3, and are pivoted about the stationary pivot pins 32 and coupled by pins at 31*b* to the secondary latch outputs 34**.

Figure 6:
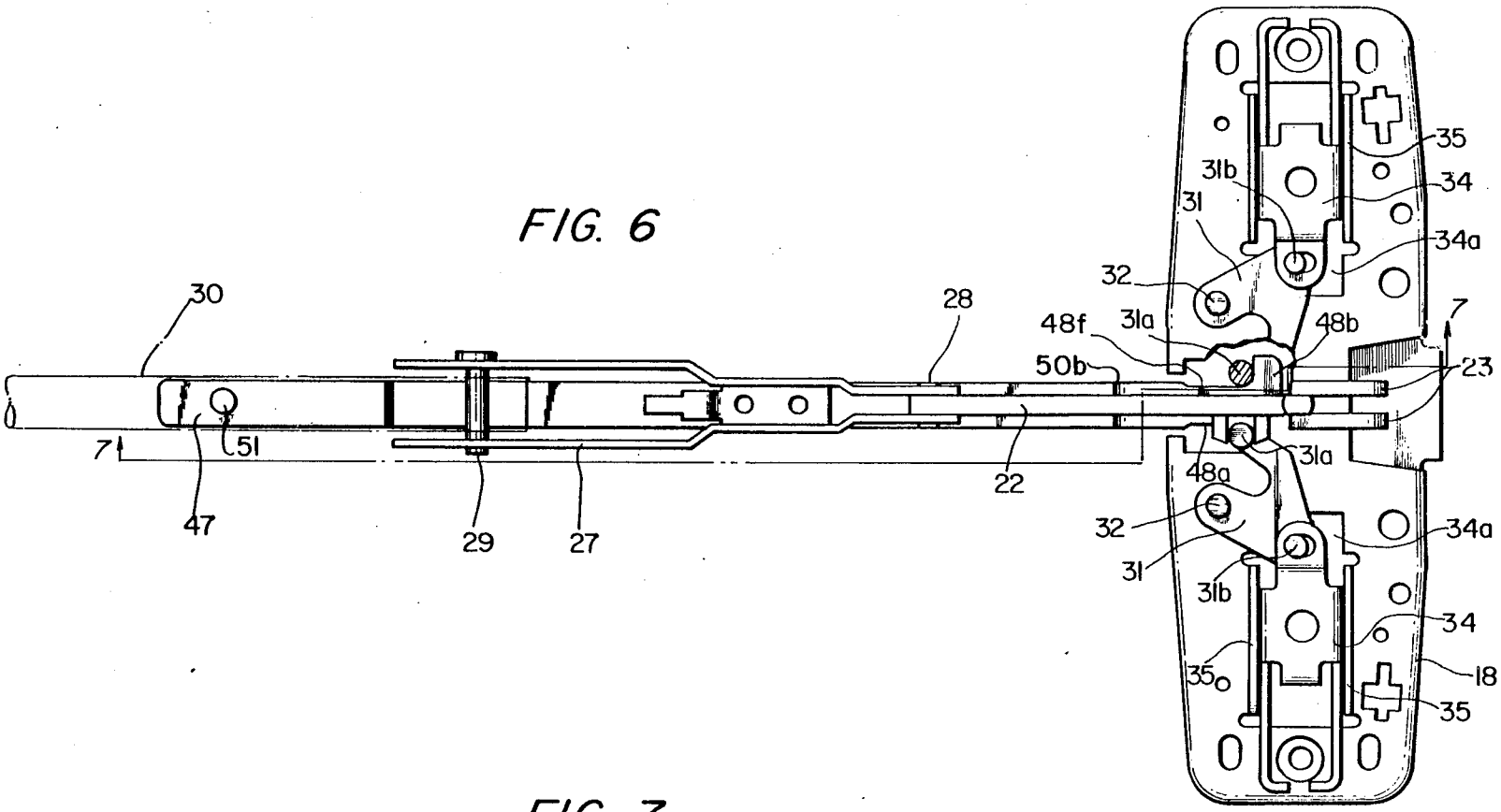
FIG. 6 is a plan view of the latch bolt operating mechanism interior component and the combination lock and deadbolt section components, constructed in accordance with the present invention to render the exterior operating mechanism for the panic exit device and the exterior combination lock mechanisms independently operational relative to each other.
Figure 7:
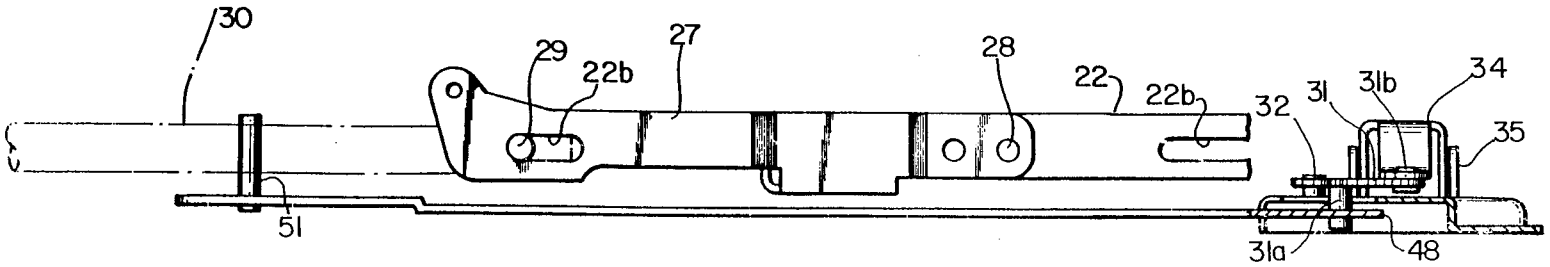
FIG. 7 is a sectional view of the mechanism in FIG. 6 taken along line 7—7 of FIG. 6, with some parts removed for clarity.

As can be observed from FIG. 6, the actuating pin 51 fixed to and projecting from the action rod 30 through the hole 46 in the coupling link 45 normally locates the coupling link 45 at its projected position shown in FIGS. 6 & 7 wherein the pin **31*a* rests at the corner of the T-shaped head 48 defined by one of the shoulders, for example shoulder 48*d*, and the adjoining relieved edge 48*f* of the shaft portion 48*a* when both the panic exit device and the high security lock are secure or in locking position. Depressing the push bar 11 of the panic exit device inputs the action rod 30, which in turn pulls the main linkage 22 and the trigger stamping or lost motion coupling link 45 to the left as viewed in FIGS. 6 and 7. Thus the trigger stamping or lost motion coupling link 45, retracted rearwardly by inward depression of the push bar 11, retracts the primary latch bolt 26 and secondary latch outputs 34, since its shoulder 48*d* is against the pin 31*a* extending from one of the pivoted bellcranks 31 and the bellcranks are in turn coupled to the secondary latch outputs 34. The other bellcrank 31 is activated by the main coupling link 22 connected the same way as in the prior art arrangement of FIG. 2**.

Opening of the associated door from the outside requires proper activation of the digital access control system or card control system to supply an activating signal to the solenoid **30*a*, or in some installations requires unlocking of a cylinder lock by a proper key, as well as proper operation of the high security combination lock. When retracting the high security combination lock 41, including its associated deadbolt section 40 coupled to the secondary output 31 associated with the bellcrank carrying pin 31*a*, the trigger stamping or lost motion coupling link 45 is not moved, since the pin 31*a* simply moves rearwardly along the adjacent recessed edge 48*f* from shoulder 48*d*, providing the lost motion such that the latch bolt 26 of the panic exit device will not retract. When retracting the primary latch bolt 26 of the panic exit device by surreptitious entry techniques (for example, when the latch bolt 46 is forced to retract by a tool manipulated by one seeking surreptitious or unauthorized entry), the secondary latch outputs 34 remains stationary preventing the high security combination lock from retracting. Lost motion between the main control link 22 and the push pad 11 is already attained by the control linkage, by reason of the slots 22*a*, 22*b* in the link member 22, and thus the control linkage allows the primary latch bolt 26 and main control link 22 to retract without inputing the action rod 30. Thus the exposure to illegal or surreptitious entry allowed by the previous designs using a solid linkage between the main control link and the secondary outputs is avoided, since depression of the secondary latch outputs does not effect retraction of the main control link coupled to the primary latch bolt 26 because of the lost motion coupling system provided by the stamping or coupling link 45**. This design, as previously stated, also eliminates the need for two doors in applications where both high security and panic egress requirements are needed, as the panic device in conjunction with the high security combination lock on the same door meets these requirements. Also, the new design makes defeat of the system much more difficult since two latches have to be defeated simultaneously in order to gain entry.

I claim:

1. A combined panic exit and combination lock assembly for a security area door including a door latching panic exit device and a high security combination lock intercoupled therewith wherein operation of a panic bar from within the security area concurrently retracts both the latch bolt means of the panic exit device and lock bolt means of the combination lock for egress from the security area through an associated door while retraction of the latch bolt means and of the lock bolt means from outside the door requires independent unlocking operation of both the panic exit device and combination lock, retraction of either the latch bolt means or the lock bolt means from outside being ineffective to retract the other bolt means;

comprising a panic exit device housing to be fixed on the door against an inside surface of the door, an elongated push plate forming said panic bar movable outwardly and inwardly relative to the door surface, a primary latch bolt extendable from said exit device, actuator means for the latch bolt including a main control link and a primary latch output operatively coupled therewith for retracting and projecting the primary latch bolt and a rod member movable to retract the primary latch bolt, secondary output means including a secondary output member, at least one pivoted bellcrank having an arm pivotally connected to said secondary output member to move the latter to retracted position coordinately with the primary latch bolt;

a combination lock having means operated by a combination lock dial to retract and project a secondary bolt and an associated primary lock bolt when the proper combination has been dialed, a rotatable member to retract the primary lock bolt, and linking means coupling the rotatable member with said secondary output to activate the associated bellcrank to retract the secondary latch bolt;

and an elongated coupling link substantially paralleling and located closely adjacent to the inside door surface having a first end coupling between said coupling link and said rod member and a second end coupling between said coupling link and said bellcrank, said coupling link and associated first and second end couplings including a lost motion intercoupling including means for transferring retracting movement to said secondary output from the rod member without relative lost motion to achieve concurrent retracting movement of the primary latch bolt and the primary lock bolt and for accommodating relative lost motion movement of the secondary output relative to the rod member upon retraction of the secondary output and associated primary lock bolt whereby unlocking of the combination lock retracts said primary lock bolt and secondary output linked thereto through said rotatable member without retracting said primary latch bolt.

2. A combined panic exit and combination lock assembly as defined in claim 1, wherein said secondary output means includes a second secondary output member for projecting and retracting a secondary vertical latch bolt and a bellcrank pivotally connected to the second secondary output member and pivoted by said main control link to effect retraction of the secondary latch bolt concurrently with said primary latch bolt responsive to inward movement of the push bar.

3. A combined panic exit and combination lock assembly as defined in claim 1, wherein said lost motion intercoupling comprises a pin fixed on the bellcrank and a pin-receiving recess at one of the end couplings of said coupling link, the pin being located in the recess adjacent an end thereof whereby the pin moves through the recess in a first direction without transferring movement to the coupling link during retracting movement of the secondary output member whereas retracting movement of the rod member and main control link is transferred to such secondary output member through interengagement of an end of the recess with the pin during movement of coupling link in a second opposite direction.

4. A combined panic exit and combination lock assembly as defined in claim 2, wherein said lost motion intercoupling comprises a pin fixed on the first-mentioned bellcrank and a pin-receiving recess at one of the end couplings of said coupling link, the pin being located in the recess adjacent an end thereof whereby the pin moves through the recess without transferring movement to the coupling link during retracting movement of the first-mentioned secondary output member whereas retracting movement of the rod member and main control link is transferred to such secondary output member through interengagement of an end of the recess with the pin during movement of coupling link in a second opposite direction.

5. A combined panic exit and combination lock assembly as defined in claim 3, wherein said pin-receiving recess at one end of said coupling link is defined by a T-shaped head having a cross-piece portion extending transversely of the coupling link and a longitudinally extending shank alongside which said pin moves between a first limit position abutting an edge of said cross-piece portion and a second limit position spaced therefrom corresponding to the pin position occupied when said primary lock bolt is fully retracted.

6. A combined panic exit and combination lock assembly as defined in claim 4, wherein said pin-receiving recess at one end of said coupling link is defined by a T-shaped head having a cross-piece portion extending transversely of the coupling link and a longitudinally extending shank alongside which said pin moves between a first limit position abutting an edge of said cross-piece portion and a second limit position spaced therefrom corresponding to the pin position occupied when said primary lock bolt is fully retracted.

7. A combined panic exit and combination lock assembly as defined in claim 1, wherein said panic exit device includes a center case subassembly having a mounting base which includes a portion spaced outwardly from said door inside surface forming a mounting plate and a peripheral rim return to said surface, said bellcrank being located in a plane adjacent and outwardly overlying said mounting plate, said coupling link being disposed in a plane adjacent the rearmost portions of said peripheral rim, and said lost motion intercoupling including means depending from said bellcrank confronting and movable relative to said coupling link for lost-motion engagement and movement thereby.

8. A combined panic exit and combination lock assembly as defined in claim 2, wherein said panic exit device includes a center case subassembly having a mounting base which includes a portion spaced outwardly from said door inside surface forming a mounting plate and a peripheral rim return to said surface, said bellcranks being located in a plane adjacent and outwardly overlying said mounting plate, said coupling link being disposed in a plane adjacent the rearmost portions of said peripheral rim, and said lost motion intercoupling including means depending from said first-mentioned bellcrank confronting and movable relative to said coupling link for lost-motion engagement and movement thereby.

9. A combined panic exit and combination lock assembly as defined in claim 1, wherein said panic exit device includes a center case subassembly having a mounting base which includes a portion spaced outwardly from said door inside surface forming a mounting plate and a peripheral rim return to said surface, said bellcrank being located in a plane adjacent and outwardly overlying said mounting plate, said coupling link being disposed in a plane adjacent the rearmost portions of said peripheral rim, and said lost motion intercoupling including a pin depending from said bellcrank to a position immediately adjacent and alongside said coupling link confronting edge portions of the second end thereof for lost-motion engagement and movement of the pin and bellcrank thereby.

10. A combined panic exit and combination lock assembly as defined in claim 2, wherein said panic exit device includes a center case subassembly having a mounting base which includes a portion spaced outwardly from said door inside surface forming a mounting plate and a peripheral rim return to said surface, said bellcranks being located in a plane adjacent and outwardly overlying said mounting plate, said coupling link, being disposed in a plane adjacent the rearmost portions of said peripheral rim, and said lost motion intercoupling include a pin depending from said first-mentioned bellcrank to a position immediately adjacent and alongside said coupling link confronting edge portions of the second end thereof for lost-motion engagement and movement of the pin and bellcrank thereby.

11. A combination panic exit and combination lock subassembly as defined in claim 1, including a mechanism for applying retractive force to said main control link from exterior access control means located at the outside of the door operative to activate said main control link to retract the primary latch bolt without transferring retracting movement to said secondary output.

12. A combination panic exit and combination lock subassembly as defined in claim 2, including a mechanism for applying retractive force to said main control link from exterior access control means located at the outside of the door operative to activate said main control link to retract the primary latch bolt without transferring retracting movement to said secondary outputs.

13. A combination panic exit and combination lock subassembly as defined in claim 1, including exterior access control means located at the outside of the door operative by selected code inputs manually supplied thereto to generate an electrical retract signal, and solenoid means coupled to said main control link and energized by said retract signal to activate said main control link to retract the primary latch bolt without transferring retracting movement to said secondary output.

14. A combination panic exit and combination lock subassembly as defined in claim 2, including exterior access control means located at the outside of the door operative by selected code inputs manually supplied thereto to generate an electrical retract signal, and solenoid means coupled to said main control link and energized by said retract signal to activate said main control link to retract the primary latch bolt without transferring retracting movement to said secondary outputs.

15. A combination panic exit and combination lock subassembly as defined in claim 5, including exterior access control means located at the outside of the door operative by selected code inputs manually supplied thereto to generate an electrical retract signal, and solenoid means coupled to said main control link and energized by said retract signal to activate said main control link to retract the primary latch bolt without transferring retracting movement to said secondary outputs.

16. A combination panic exit and combination lock subassembly as defined in claim 6, including exterior access control means located at the outside of the door operative by selected code inputs manually supplied thereto to generate an electrical retract signal, and solenoid means coupled to said main control link and energized by said retract signal to activate said main control link to retract the primary latch bolt without transferring retracting movement to said secondary outputs.

17. A combination panic exit and combination lock subassembly as defined in claim 7, including exterior access control means located at the outside of the door operative by selected code inputs manually supplied thereto to generate an electrical retract signal, and solenoid means coupled to said main control link and energized by said retract signal to activate said main control link to retract the primary latch bolt without transferring retracting movement to said secondary outputs.

18. A combination panic exit and combination lock subassembly as defined in claim 8, including exterior access control means located at the outside of the door operative by selected code inputs manually supplied thereto to generate an electrical retract signal, and solenoid means coupled to said main control link and energized by said retract signal to activate said main control link to retract the primary latch bolt without transferring retracting movement to said secondary outputs.

19. A combined panic exit and exterior access lock assembly for a security area door including a door latching panic exit device and an exterior access lock intercoupled therewith within operation of a panic bar from within the security area concurrently retracts both the latch bolt means of the panic exit device and lock bolt means of the exterior access lock for egress from the security area through an associated door while retraction of the latch bolt means of the lock bolt means from outside the door requires independent unlocking operation of both the panic exit device and exterior access lock, retraction of either the latch bolt means or the lock bolt means from outside being ineffective to retract the other bolt means;

comprising a panic exit device housing to be fixed on the door against an inside surface of the door, an elongated push plate forming said panic bar movable outwardly and inwardly relative to the door surface, a primary latch bolt extendable from said exit device, actuator means for the latch bolt including a main control link and a primary latch output operatively coupled therewith for retracting and projecting the primary latch bolt and a rod member movable to retract the primary latch bolt, secondary output means including a secondary output member, at least one pivoted bellcrank having an arm pivotally connected to said secondary output member to move the latter to retracted position coordinately with the primary latch bolt;

an exterior access lock having means operable to retract and project a secondary bolt and an associated primary lock bolt when the exterior access lock has been properly operated to unlock the same, a rotatable member to retract the primary lock bolt, and linking means coupling the rotatable member with said secondary output to activate the associated bellcrank to retract the secondary latch bolt;

and an elongated coupling link substantially paralleling and located closely adjacent to the inside door surface having a first end occupying between said coupling link and said rod member and a second end coupling between said coupling link and said bellcrank, said coupling link and associated first and second end couplings including a lost motion intercoupling including means for transferring retracting movement to said secondary output from the rod member without relative lost motion to achieve concurrent retracting movement of the primary latch bolt and the primary lock bolt and for accommodating relative lost motion movement of the secondary output relative to the rod member upon retraction of the secondary output and associated primary lock bolt whereby unlocking of the exterior access lock retracts said primary lock bolt and secondary output linked thereto through said rotatable member without retracting said primary latch bolt.

20. A combined panic exit and exterior access lock assembly as defined in claim 19, wherein said secondary output means includes a second secondary output member for projecting and retracting a secondary vertical latch bolt and a bellcrank pivotally connected to the second secondary output member and pivoted by said main control link to effect retraction of the secondary latch bolt concurrently with said primary latch bolt responsive to inward movement of the push bar.

21. A combined panic exit and exterior access assembly as defined in claim 19, wherein said lost motion intercoupling comprises a pin fixed on the bellcrank and a pin-receiving recess at one of the end couplings of said coupling link, the pin being located in the recess adjacent an end thereof whereby the pin moves through the recess in a first direction without transferring movement to the coupling link during retracting movement of the secondary output member whereas retracting movement of the rod member and main control link is transferred to such secondary output member through interengagement of an end of the recess with the pin during movement of coupling link in a second opposite direction.

22. A combined panic exit exterior access lock assembly as defined in claim 20, wherein said lost motion intercoupling comprises a pin fixed on the first-mentioned bellcrank and a pin-receiving recess at one of the end couplings of said coupling link, the pin being located in the recess adjacent an end thereof whereby the pin moves through the recess without transferring movement to the coupling link during retracting movement of the first-mentioned secondary output member whereas retracting movement of the rod member and main control link is transferred to such secondary output member through interengagement of an end of the recess with the pin during movement of coupling link in a second opposite direction.

23. A combined panic exit and exterior access lock assembly as defined in claim 21, wherein said pin-receiving recess at one end of said coupling link is defined by a T-shaped head having a cross-piece portion extending transversely of the coupling link and a longitudinally extending shank alongside which said pin moves between a first limit position abutting an edge of said cross-piece portion and a second limit position spaced therefrom corresponding to the pin position occupied when said primary bolt is fully retracted.

24. A combined panic exit and exterior access lock assembly as defined in claim 22, wherein said pin-receiving recess at one end of said coupling link is defined by a T-shaped head having a cross-piece portion extending transversely of the coupling link and a longitudinally extending shank alongside which said pin moves between a first limit position abutting an edge of said cross-piece portion and a second limit position spaced therefrom corresponding to the pin position occupied when said primary lock bolt is fully retracted.

25. A combined panic exit and exterior access lock assembly as defined in claim 19, wherein said panic exit device includes a center case subassembly having a mounting base which includes a portion spaced outwardly from said door inside surface forming a mounting plate and a peripheral rim return to said surface, said bellcrank being located in a plane adjacent and outwardly overlying said mounting plate, said coupling link being disposed in a plane adjacent the rearmost portions of said peripheral rim, and said lost motion intercoupling including means depending from said bellcrank confronting and movable relative to said coupling link for lost-motion engagement and movement thereby.

26. A combined panic exit and exterior access lock assembly as defined in claim 20, wherein said panic exit device includes a center case subassembly having a mounting base which includes a portion spaced outwardly from said door inside surface forming a mounting plate and a peripheral rim return to said surface, said bellcranks being located in a plane adjacent and outwardly overlying said mounting plate, said coupling link being disposed in a plane adjacent the rearmost portions of said peripheral rim, and said lost motion intercoupling including means depending from said first-mentioned bellcrank confronting and movable relative to said coupling link for lost-motion engagement and movement thereby.

27. A combined panic exit and exterior access lock assembly as defined in claim 19, wherein said panic exit device includes a center case subassembly having a mounting base which includes a portion spaced outwardly from said door inside surface forming a mounting plate and a peripheral rim return to said surface, said bellcrank being located in a plane adjacent and outwardly overlying said mounting plate, said coupling link being disposed in a plane adjacent the rearmost portions of said peripheral rim, and said lost motion intercoupling including a pin depending from said bellcrank to a position immediately adjacent and alongside said coupling link confronting edge portions of the second end thereof for lost-motion engagement and movement of the pin and bellcrank thereby.

28. A combined panic exit and exterior access lock assembly as defined in claim 20, wherein said panic exit device includes a center case subassembly having a mounting base which includes a portion spaced outwardly from said door inside surface forming a mounting plate and a peripheral rim return to said surface, said bellcranks being located in a plane adjacent and outwardly overlying said mounting plate, said coupling link, being disposed in a plane adjacent the rearmost portions of said peripheral rim, and said lost motion intercoupling include a pin depending from said first-mentioned bellcrank to a position immediately adjacent and alongside said coupling link confronting edge portions of the second end thereof for lost-motion engagement and movement of the pin bellcrank thereby.

29. A combination panic exit and exterior access lock subassembly as defined in claim 19, including a mechanism for applying retractive force to said main control link from exterior access control means located at the outside of the door operative to activate said main control link to retract the primary latch bolt without the transferring retracting movement to said secondary output.

* * * * *